US010815685B2

(12) United States Patent
Rainville

(10) Patent No.: US 10,815,685 B2
(45) Date of Patent: Oct. 27, 2020

(54) TEMPORARY SAFETY GUARDRAIL FOR CONSTRUCTION SITES

(71) Applicant: Sylvain Rainville, St-Bruno-de-Montarville (CA)

(72) Inventor: Sylvain Rainville, St-Bruno-de-Montarville (CA)

( * ) Notice: Subject to any disclaimer, the term of this patent is extended or adjusted under 35 U.S.C. 154(b) by 112 days.

(21) Appl. No.: 16/052,717

(22) Filed: Aug. 2, 2018

(65) Prior Publication Data

US 2019/0040640 A1 Feb. 7, 2019

(30) Foreign Application Priority Data

Aug. 2, 2017 (GB) ..... 1712467.8

(51) Int. Cl.
*E04G 21/32* (2006.01)
*E04G 5/14* (2006.01)

(52) U.S. Cl.
CPC ..... *E04G 21/3233* (2013.01); *E04G 21/3223* (2013.01); *E04G 21/3266* (2013.01); *E04G 2005/148* (2013.01)

(58) Field of Classification Search
CPC ..... E04G 21/3233; E04G 21/3223; E04G 21/3266; E04G 2005/148; E04H 17/1421; E04H 2017/1447; E04H 2017/1482
USPC ..... 182/112, 113; 256/1, 59, 65.01, 65.03, 256/65.04, 65.05, 65.14, 67, DIG. 6
See application file for complete search history.

(56) References Cited

U.S. PATENT DOCUMENTS

| | | | | |
|---|---|---|---|---|
| 2,706,662 | A | 4/1955 | Brown | |
| 3,089,681 | A * | 5/1963 | Smithwick | E04H 17/10 256/47 |
| 3,527,319 | A | 9/1970 | Pedley | |
| 3,880,405 | A | 4/1975 | Brueske | |
| 3,901,481 | A | 8/1975 | Probst | |
| 4,826,122 | A | 5/1989 | Cupp | |
| 4,852,692 | A | 8/1989 | Flaherty | |
| 5,182,889 | A * | 2/1993 | Johnson | E04G 21/3219 52/298 |
| 5,221,076 | A | 6/1993 | Züst | |
| 6,053,281 | A | 4/2000 | Murray | |
| 6,131,886 | A * | 10/2000 | Venegas, Jr. | E01F 13/022 256/13.1 |
| 6,279,880 | B1 | 8/2001 | Hawks, Jr. | |
| 6,336,623 | B1 | 1/2002 | McCarthy | |
| 6,467,230 | B1 * | 10/2002 | Perkins | E04F 11/1812 248/220.1 |
| 6,857,504 | B1 | 2/2005 | Branter | |
| 7,063,186 | B1 | 6/2006 | Granke | |
| 10,087,651 | B2 * | 10/2018 | Cavanagh | E04H 17/163 |
| 2004/0041141 | A1 * | 3/2004 | Cannon | E04G 21/3223 256/65.05 |
| 2006/0180390 | A1 | 8/2006 | Thaler | |

(Continued)

*Primary Examiner* — William V Gilbert

(57) ABSTRACT

A temporary safety guardrail for construction sites is provided. The guardrail includes specially designed anchoring members configured to accept removable posts which vertically extend from each anchoring member. On top of each posts, a guardrail is provided in two versions, a fixed length handrail or a telescopic handrail. Either handrail is connected directly to a fixed bracket, or indirectly by way of one or more orientable bracket so that the guardrail can be oriented to different angles so as to follow the building's contour, such as going up and down staircases or doing corners.

14 Claims, 8 Drawing Sheets

(56) References Cited

U.S. PATENT DOCUMENTS

2006/0237263 A1* 10/2006 Gaines ..... E04G 3/26
182/113
2018/0023310 A1* 1/2018 Smith ..... E04G 21/3219
182/112

* cited by examiner

TEMPORARY SAFETY GUARDRAIL FOR CONSTRUCTION SITES

CROSS-REFERENCE TO RELATED APPLICATIONS

The present application claims priority to United Kingdom Patent Application serial number G131712467.8, filed on Aug. 2, 2017 entitled "Temporary safety guardrail for construction sites", the disclosure of which is hereby incorporated in its entirety at least by reference.

BACKGROUND OF THE INVENTION

1. Field of the Invention

The present invention relates generally to guardrails but more particularly to a temporary safety guardrail for construction sites.

2. Description of Related Art

Safety regulations on construction sites can be very strict in many jurisdictions and generally require that a form of temporary safety guardrail be installed around the perimeter of a building that is under construction. Usually, those guardrails are quickly assembled by the workers who will use planks of woods, sometimes from scrap. Often, those guardrail sections are reused from site to site and are fixed up as needed so that they remain relatively secure. There are some types of metal guardrails that are specifically designed for construction sites, but the problem usually has to do with how to secure them to the existing structure. Consequently, there is a need for a temporary safety guardrail for construction sites that can easily secure to existing structures and provide any necessary perimeter configuration.

BRIEF SUMMARY OF THE INVENTION

In one embodiment of the present invention a temporary safety guardrail for construction sites comprising a plurality of anchoring members, each anchoring member having a post connecting bracket configured to receive a removable post, the posts are defined as starter or intermediate posts wherein starter can be first or last, and a base plate having a plurality of plate holes configured to receive mechanical fasteners, wherein the post connecting bracket includes a horizontal opening and a vertical opening enabling each anchoring member to be installed and secured to a surface in either a horizontal or vertical position via the plurality of plate holes; a rectangular fixed bracket positioned on a top portion of the removable post, the rectangular fixed bracket having a pair of attachment holes on each end of each face of the rectangular fixed bracket; a rectangular handrail having a pair of vertically aligned attachment holes on each end of each horizontal face of the rectangular handrail, wherein the rectangular handrail is configured to attach to one end of the rectangular fixed bracket via a first pin passed through the pair of vertically aligned attachment holes and the corresponding attachment holes on the rectangular fixed bracket, and the other end of the rectangular handrail is configured to attach to an additional rectangular fixed bracket on an adjacent removable post such that a series of handrails is provided; and, a net having an upper band, a lower band, and a plurality of threads, wherein the net is configured to be attached to the removable post and the rectangular handrail.

In one embodiment, the rectangular handrail is a fixed length handrail. In one embodiment, the rectangular handrail is a telescoping handrail. In one embodiment, an orientable bracket configured to attach to the rectangular fixed bracket is provided, wherein the rectangular handrail is configured to attach to the orientable bracket, the orientable bracket configured to pivot along a vertical or a horizontal plane. In another embodiment, a first and second orientable bracket are connected in series such that the first orientable bracket pivots horizontally and second orientable bracket pivots vertically such that orientation occurs in two axes. In one embodiment, the optional orientable bracket comprises a body section and a pair of fins, wherein the body section is rectangular having four sides, and at least one hole provided on each of the four sides and each fin of the pair of fins, the holes configured for attachment to the rectangular fixed bracket and the rectangular handrail via a second pin. In one embodiment, a marker stub positioned on a lower portion of the removable post. In another embodiment, a kickplate bracket is configured to attach to the marker stub and receive a kickplate. In one embodiment, the fixed length handrail is approximately 84 inches in length. In one embodiment, the telescoping handrail extends up to 68 inches in length. In yet another embodiment, at least one alignment hook having notches is provided, wherein the at least one alignment hook is configured to secure the threads of the net in the notches. In one embodiment, the rectangular handrail includes hooks configured to attach to the upper band of the net, the hooks configured to create tension in a horizontal direction of the net. In one embodiment, the hooks are positioned on alternating sides of the rectangular handrail. In another embodiment, at least one band clamp positioned on the removable post, the at least one band clamp configured to secure the lower band of the net and to adjust vertical tension in the net by selective positioning into adjustment holes.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable any person skilled in the art to make and use the invention and sets forth the best modes contemplated by the inventor of carrying out their invention. Various modifications, however, will remain readily apparent to those skilled in the art, since the general principles of the present invention have been defined herein to specifically provide a temporary safety guardrail for construction sites. The word "a" is defined to mean "at least one."

Figure 1:
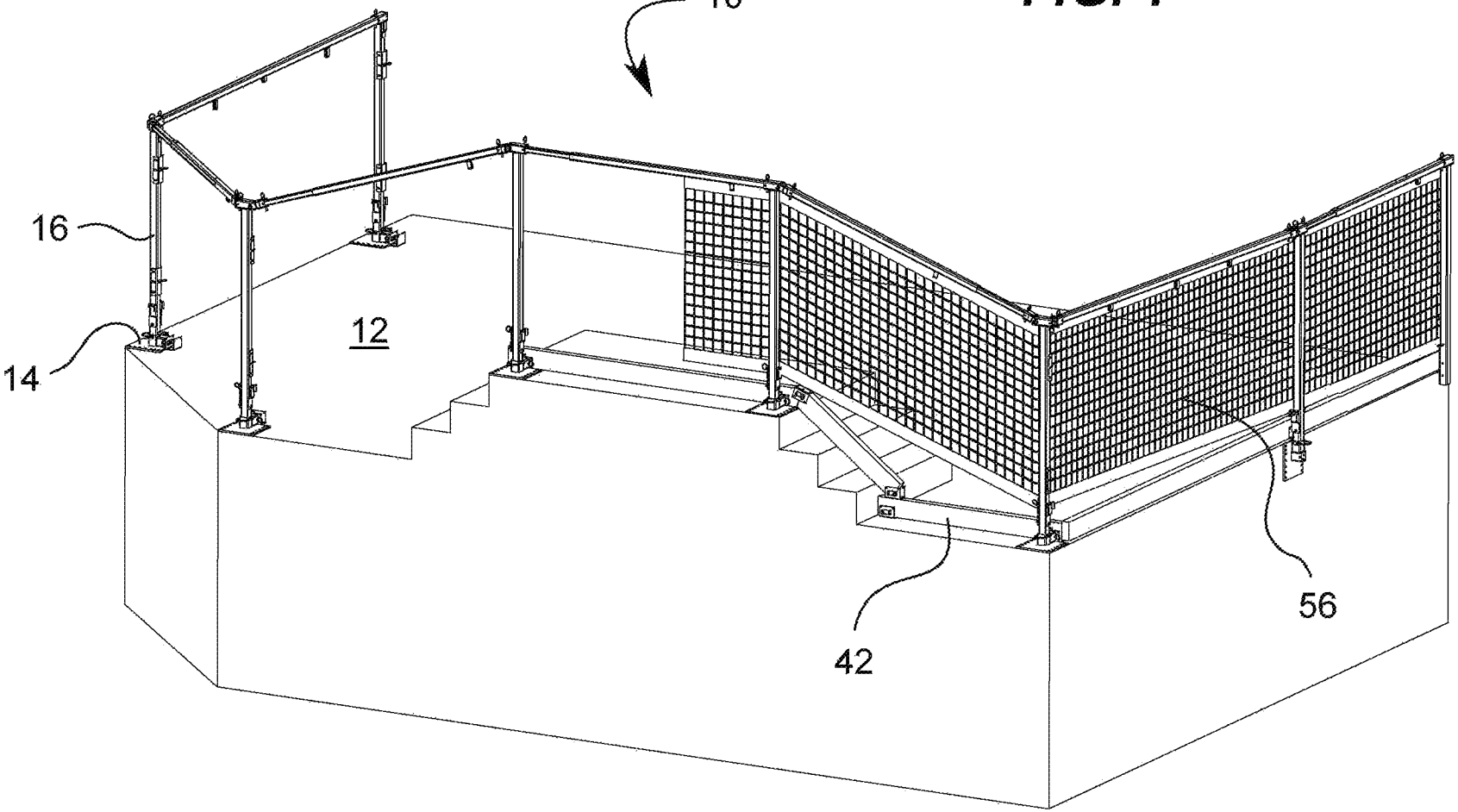
FIG. 1 is an isometric view of a temporary safety guardrail for construction sites according to an embodiment of the present invention.

Referring now to FIG. 1, a temporary safety guardrail 10 is used on the perimeter of a floor 12 or ground surface forming part of a construction site or renovation, such as a building construction as well known in the art. In one embodiment, the guardrail is comprised of a plurality of anchoring members 14 each having a removable posts 16 disposed vertically in each anchoring member. In one embodiment, a net 56 is provided between each pair of removable posts, wherein the net is configured to maintain the safety of construction worker while keeping the general public out of the construction site. In one embodiment, one or more kickplates 42 are provided, wherein the kickplates prevent loose objects on the ground from being accidentally pushed off the side of the building. The kickplates will be described in greater detail below.

Figure 2C:
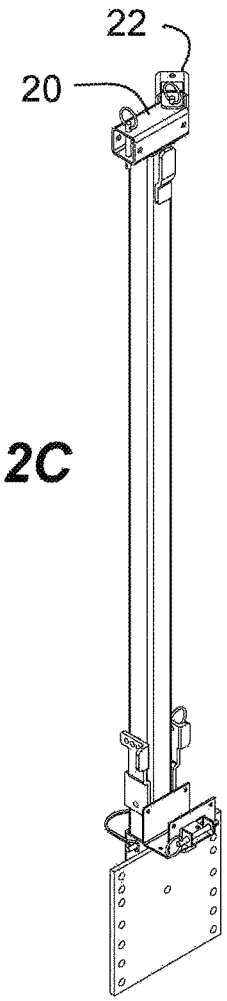
FIG. 2C is a side view of an intermediate post with anchoring member disposed vertically according to an embodiment of the present invention.
Figure 2B:
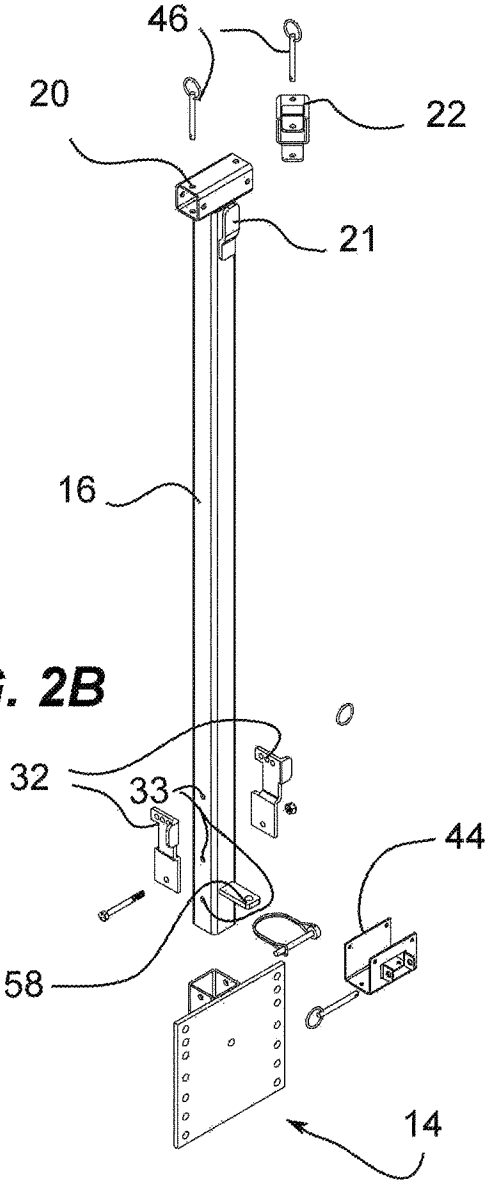
FIG. 2B is a exploded view of a center post and anchoring member according to an embodiment of the present invention.
Figure 2A:
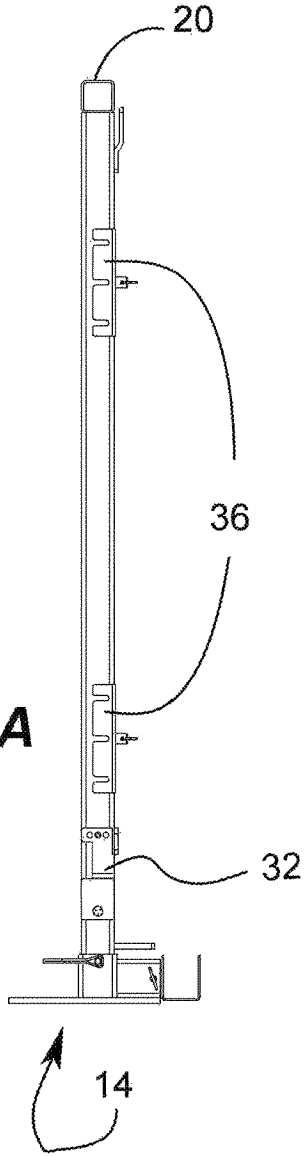
FIG. 2A is a side view of a corner post with anchoring member disposed horizontally according to an embodiment of the present invention.

Referring now to FIGS. 2A-C, various views of removable posts with anchoring members are illustrated. In one embodiment, a fixed bracket 20 is positioned on the top of the post. In some embodiments, one or more orientable brackets 22 are required depending on the desired configuration of the guiderail, which will be explained in detail below. An orientable bracket 22 is configured to pivot along a vertical or a horizontal plane depending on the orientation and connection of the bracket via the fixed bracket. If guiderail rotation is required, depending on the configuration, when two orientable brackets are connected in series, one orientable bracket can pivot horizontally and the other orientable bracket can pivot vertically such that rotation occurs in two axes. Alternatively, two orientable brackets may be connected in series and aligned so as to provide rotation in one axis that is greater than 180 degrees (up to 360 degrees).

Figure 7:
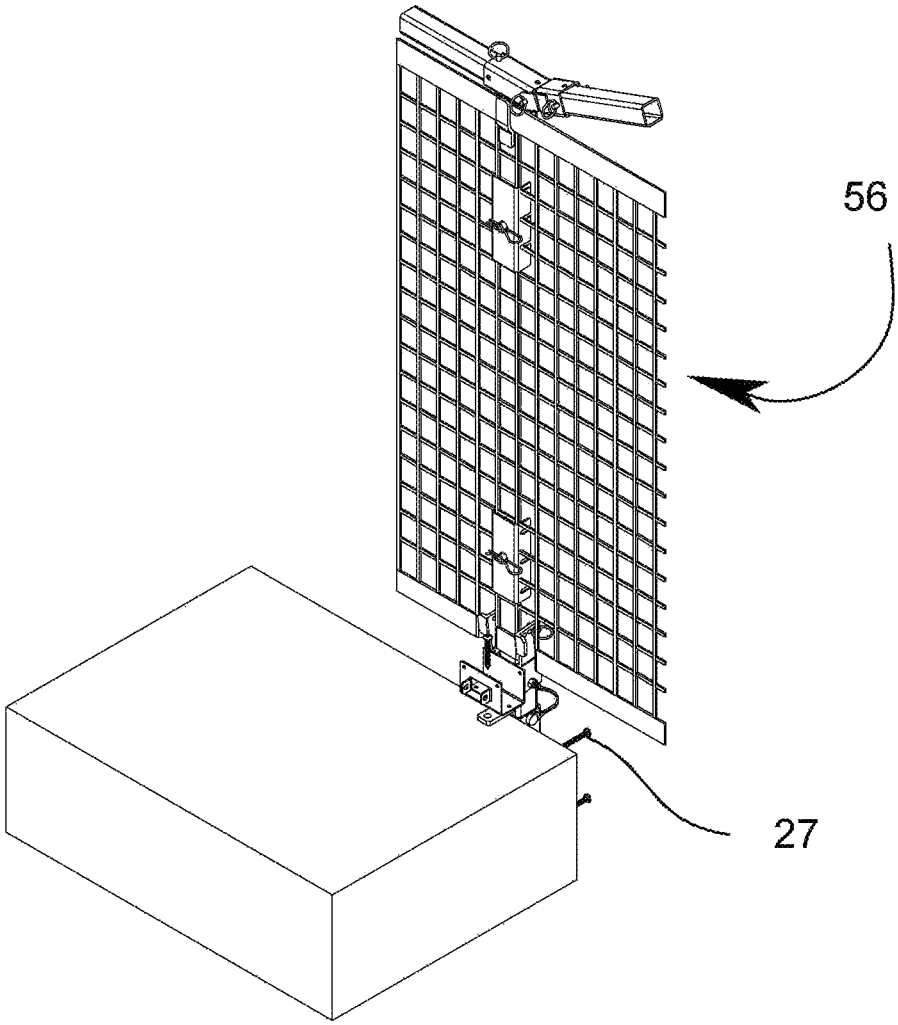
FIG. 7 is an isometric view of a starter post with a net with the base installed vertically according to an embodiment of the present invention; and, FIGS. 8A-B are isometric views of a starter post with a net with the base installed horizontally according to an embodiment of the present invention.
Figure 8B:
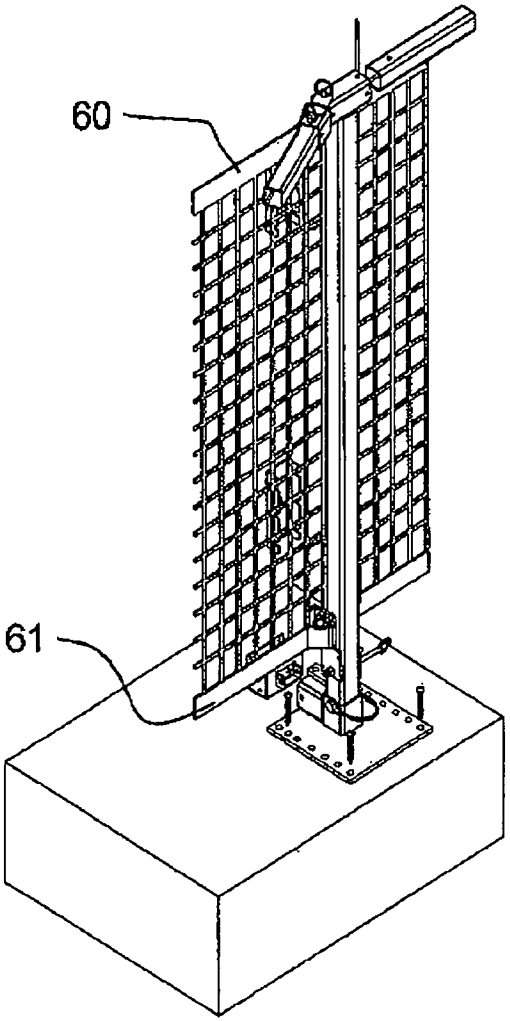
Figure 8A:
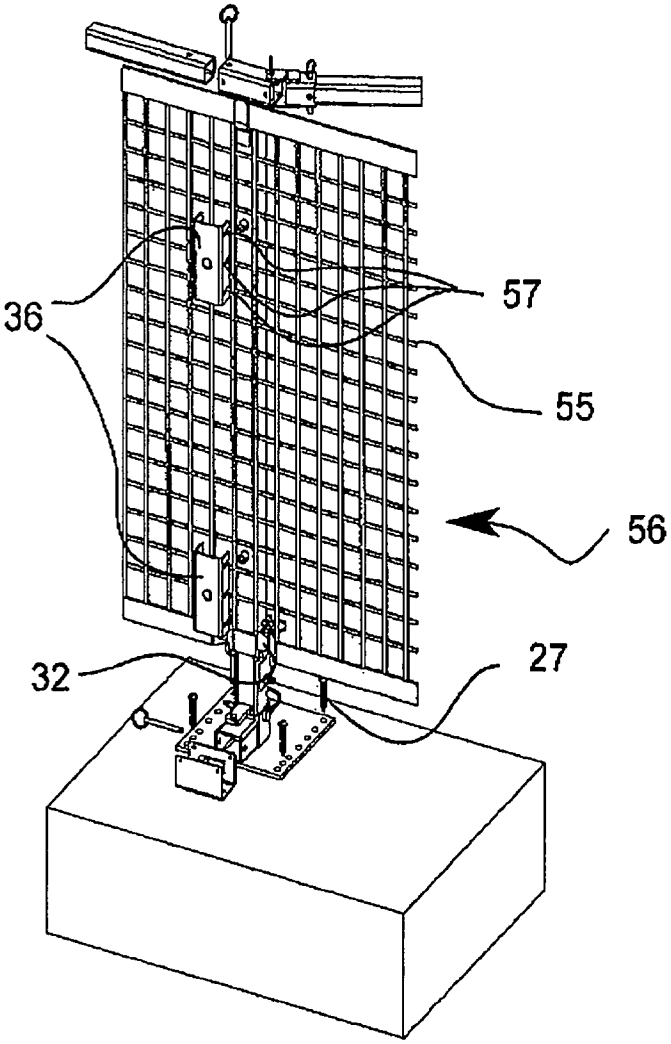

In one embodiment, anchoring member 14 includes base plate 24 having a plurality of plate holes 26 configured for receiving mechanical fasteners 27 (best seen in FIGS. 7 and 8), wherein the mechanical fasteners are any fastener known in the art, including but not limited to anchoring bolts, screws, and nails. In one embodiment, the mechanical fasteners may be fastened to a flat horizontal surface, such as floor 12 or a roof (not illustrated), but can also be oriented vertically so as to be mechanically fastened to a vertical surface such as the thickness of the floor itself.

Figures 3A, 3B:
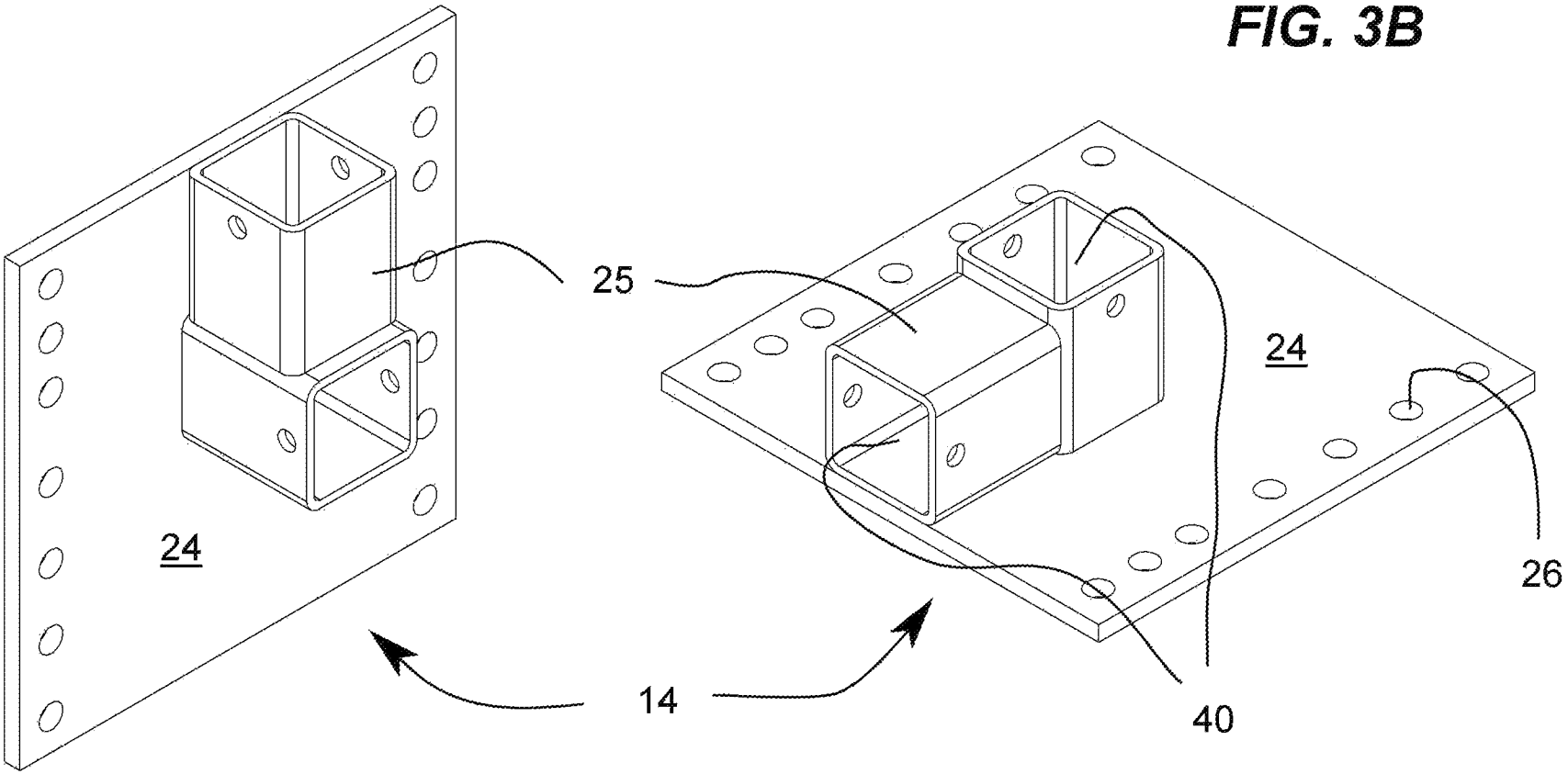
FIGS. 3A-B are isometric views of the anchoring member in vertical and horizontal configurations respectively according to an embodiment of the present invention.

Best seen in FIGS. 3A-B, the anchoring member includes a post connecting bracket 25. In one embodiment, the connecting bracket includes two openings 40 configured and sized for receiving a removable post 16, wherein the post is either in a configuration parallel or perpendicular relative to base plate 24. The various configurations are best seen in FIGS. 2A-C. It should be understood that when using the base plate in its vertical configuration, a marker stub 58 (FIG. 2B) is used so as to prevent the removable post from falling off, eliminating the need for an additional worker to hold the removable post during installation. Further, the marker stub is also configured for marking the exact height of the removable post such that all the posts used and the corresponding temporary safety guiderail is of equal height. Yet further, the marker stub is configured for mechanically fastening a kickplate bracket 44. In one embodiment, the kickplate bracket is used to install a kickplate 42 running at floor level (best seen in FIG. 1). In one embodiment, the kickplate 42 consists in planks that are held in place by being inserted into the kickplate brackets which are fixedly attached to the base of the post when the base plate is horizontal or, as described above to the marker stub when the base plate is oriented vertically.

Figure 6A:
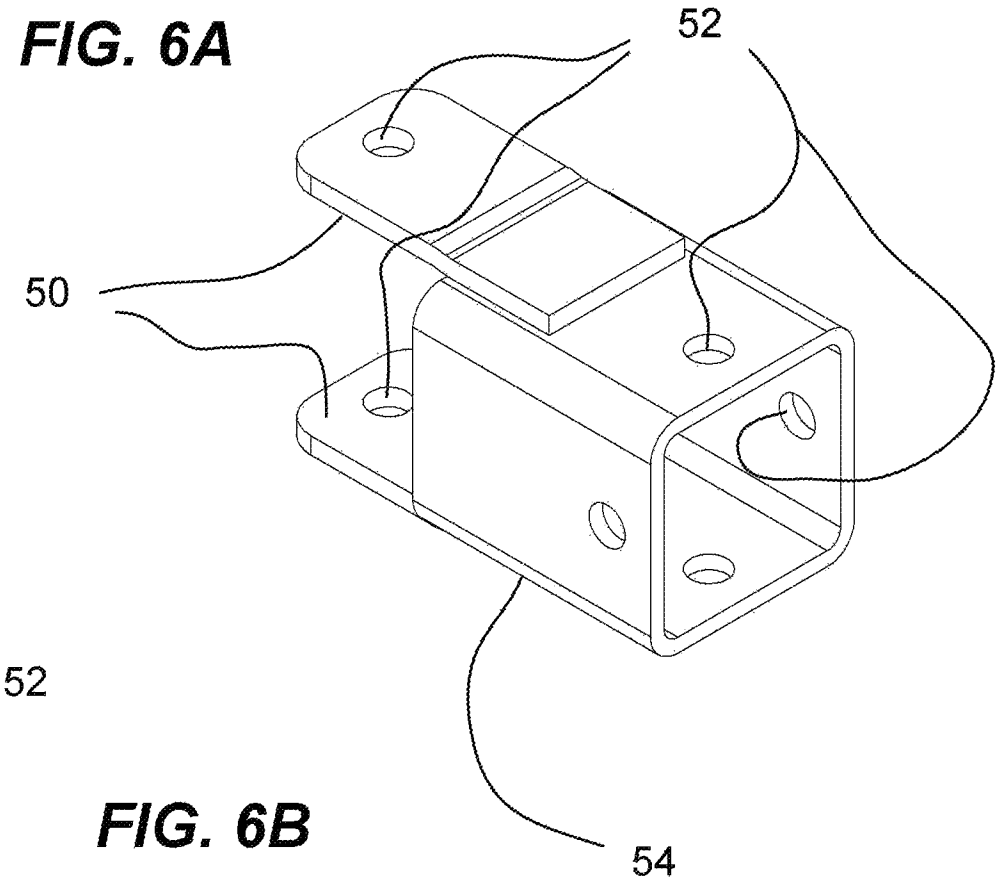
FIGS. 6A-B are isometric and side views of the orientable bracket according to an embodiment of the present invention.
Figure 6B:
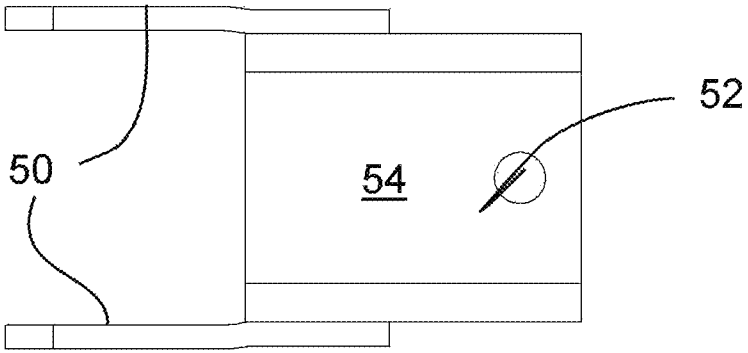

Referring now to FIGS. 6A-B, the orientable bracket is shown in greater detail. In one embodiment, the orientable bracket comprises a body section 54 and a pair of fins 50. In one embodiment, the body section is rectangular having four sides or faces, wherein the body section comprises at least one hole 52 on each side or face. Similarly, each fin of the pair of fins has at least one hole 52.

In one embodiment, a pin 46 is passed through the holes when attaching the orientable bracket to the fixed bracket. Depending on the desired plane (horizontal or vertical), specific holes are used on the fixed bracket. The fixed bracket is rectangular having a pair of holes on the ends of each face of the fixed bracket, allowing for numerous attachment arrangements. For example, if a horizontal plane orientation is desired, the orientable bracket would be aligned such that the holes provided on each fin are vertically aligned, and the pin would pass though the vertically aligned holes on the pair of fins and the corresponding vertically aligned holes on the fixed bracket (best illustrated in FIGS. 2B-C and 8A-B). Alternatively, if a vertical plane is desired, the orientable bracket would be aligned such that the holes provided on each fin are horizontally aligned, and the pin would pass through the horizontally aligned holes on the pair of fins and the corresponding horizontally aligned holes on the fixed bracket (best illustrated in FIG. 7). In one embodiment, the temporary safety guardrail includes a variety of handrails that are connected to the orientable brackets. Depending on the desired configuration of the handrails the previously mentioned methods would be used for positioning the handrail in a vertical or horizontal plane. Further, if two orientable brackets are connected serially with perpendicular fins orientation, the combination can pivot on two axis. With one hole per face, irrelevant of orientation, there will always be at least two holes properly aligned for connecting a handrail. The variety of handrails will be discussed in greater detail below.

Figure 4A:
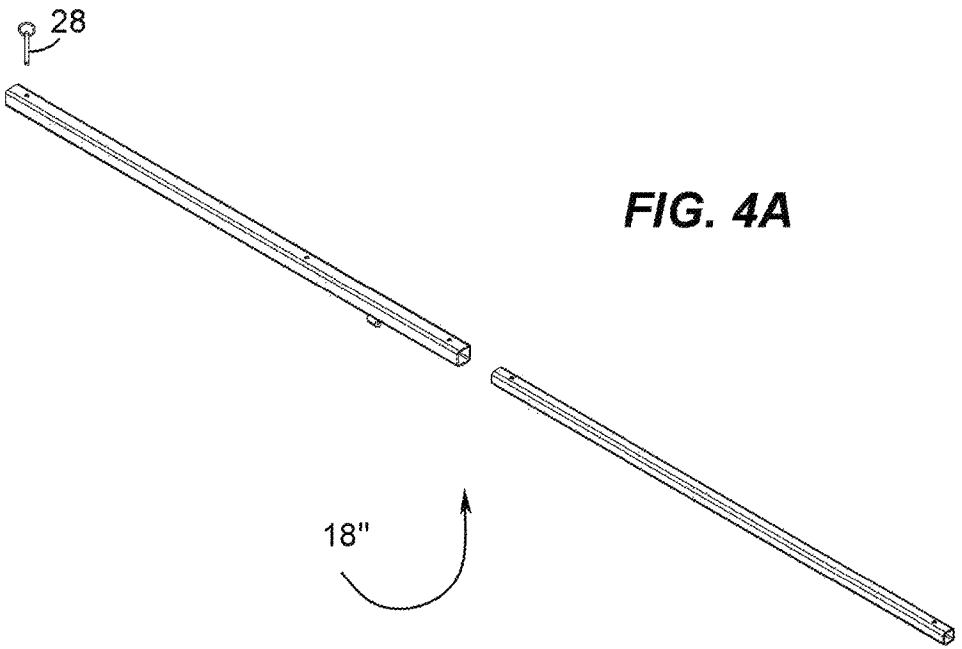
FIGS. 4A-C are isometric, side, and end views of the telescopic handrail according to an embodiment of the present invention.
Figure 4B:
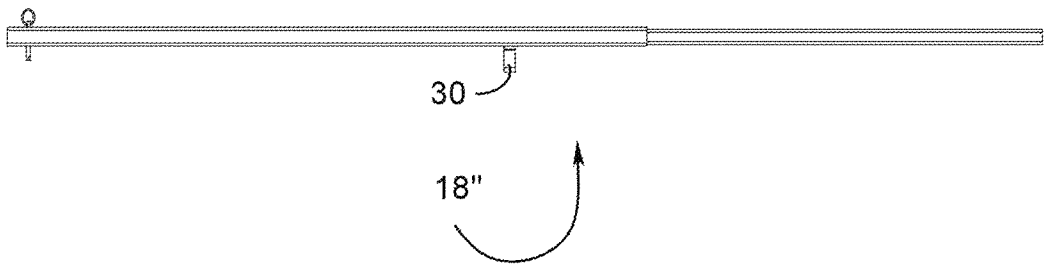
Figure 4C:
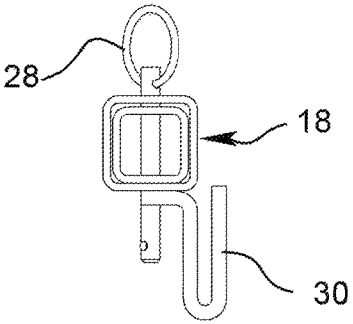
Figure 5A:
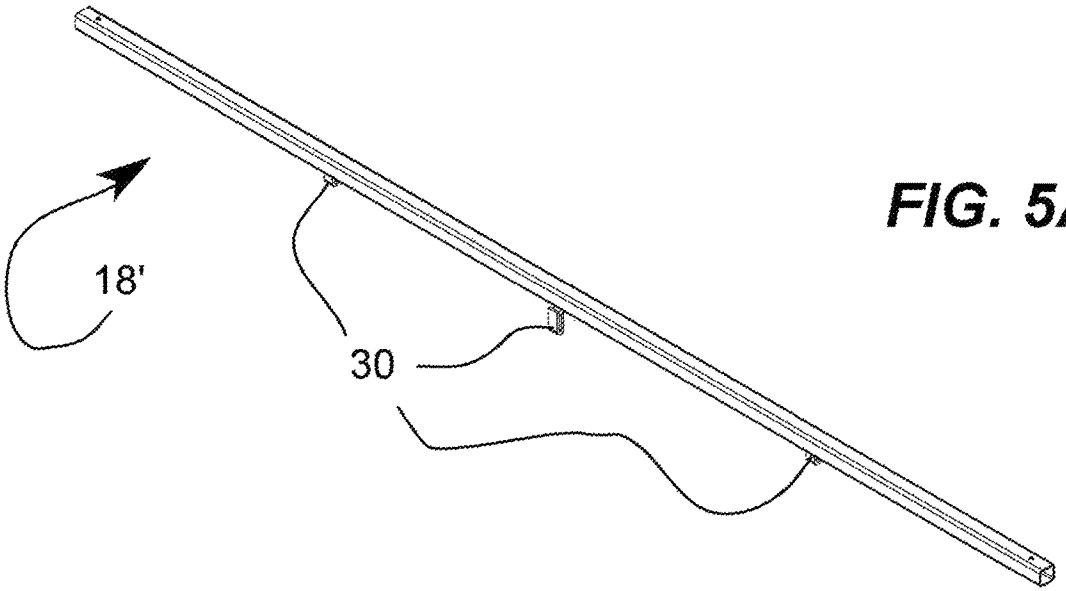
FIGS. 5A-C are isometric, side, and end views of the fixed length handrail according to an embodiment of the present invention.
Figure 5B:
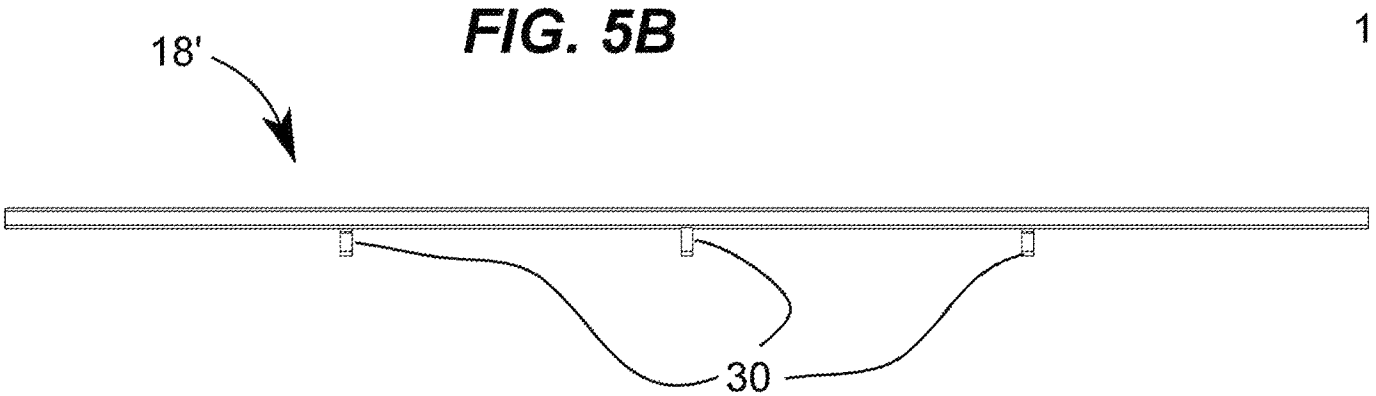
Figure 5C:
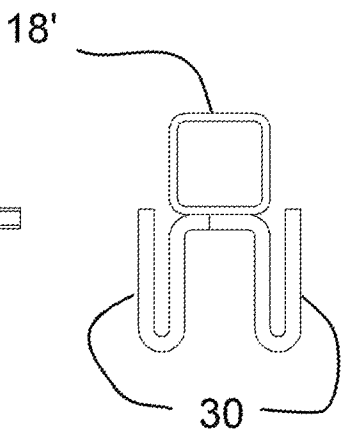

There are two types of handrails provided. Referring now to FIGS. 4A-C, a telescoping handrail 18" is shown. The telescoping handrail is comprised of at least two telescoping rectangular body members providing an adjustable length handrail as well known in the art. In one embodiment, the telescoping handrail extends up to 68 inches in length. Referring now to FIGS. 5A-C, a fixed length handrail 18' is shown. In one embodiment, the fixed length handrail approximately 84 inches in length. During installation, any variety of handrail, either fixed or telescoping, may be inserted into orientable brackets or directly into a fixed bracket if no rotation is desired. Pins 46/28 may be used to secure the handrails in the various brackets. As previously mentioned, the orientable bracket provides different angles and planes so that the handrail may follow the contours of the building perimeter, such as illustrated in FIG. 1. Thus, advantageously, by utilizing both fixed and telescopic handrails, any configuration for a safety perimeter for a construction site may be obtained.

During installation, firstly, the posts are inserted into the post connecting brackets of the base plates 24 and secured thereto via pins. Next, the handrails, either fixed length and/or telescoping are attached to the fixed or orientable brackets and secured via pins. A net 56 is then attached to mesh alignment slits 57 located on mesh alignment hooks 32 on the positioned on the first and last starter posts of a net roll all other posts 16 in between are intermediate posts 16 and do not have the mesh alignment hooks. Typically, net rolls are about 50 feet in length. Therefore, it takes 8 posts set at 7 feet apart to cover 49 feet. So, the first and eighth post are defined as starter and end posts and have the mesh alignment hooks configured to securely hold the start and the end of the net. In one embodiment, the alignment hooks are configured to secure threads 55 of the net in notches 57 (best seen in FIG. 8A) of the starter post. Next, the threads are positioned in the same order on the notches on the last starter post for the complete net roll. This ensures that each net thread is aligned from one end of the net roll to the other. Once this is done, the net is tied up in between using hooks 30 located along the each handrail, as well as a post hook 21 located at the upper part of each post. Preferably, the hooks 30 are placed on alternate sides of each handrail so as to grasp onto an upper band 60 of the net so as to create tension in the net along the horizontal by zig zagging between both sides of the handrail. Then, the net is then pulled tight along the vertical by clamping it onto band clamps 36 located on all the posts. In one embodiment, the band clamps are used for grasping and securing a lower band 61. In one embodiment, side hooks 36 are provided on a starter post and configured to receive an end of the net. Both the side hooks and the clamps may be removed and put back quickly by way of the pins so as to easily fit in the threads of the net and pull down to make the necessary adjustments. For example, the clamps have three positions dictated by adjustment holes 33 located on each post. When the net is finished, an additional net may be attached to the first net to continue setting up the perimeter. Usually, each net is equipped with a plurality grommets at their extremity through which nuts and bolts are inserted to connect to another net 56.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A temporary safety guardrail for construction sites comprising:

a plurality of anchoring members, each of the anchoring members having a post connecting bracket configured to receive a removable post, and a base plate having a plurality of plate holes receiving mechanical fasteners, wherein the post connecting bracket includes a first opening perpendicular to a second opening, each of the openings enabling each of the anchoring members to be installed and secured to a surface in either a horizontal or vertical position via the plurality of plate holes;

a rectangular fixed bracket positioned on a top portion of the removable post and having a pair of attachment holes on each face of the rectangular fixed bracket;

a plurality of rectangular handrails, each of the rectangular handrails having a pair of attachment holes on each end wherein each rectangular handrail attaches to a first end of the rectangular fixed bracket via a first pin passed through a first one of the attachment holes and a second one of the attachments holes on an opposite side of a respective one of the attachments holes on an opposite side of a respective one of the rectangular handrails than the respective first one of the attachment holes, and a second end of each of the rectangular handrails opposite the first end is attached to an additional rectangular fixed bracket on an additional adjacent removable post such that a series of the rectangular handrails is provided; and, a net having a first band extending along a first edge, a second band extending along a second edge opposite the first edge, and a plurality of threads, wherein the net is configured to attach to the removable post and the handrail.

2. The temporary safety guardrail for construction sites of claim 1, wherein each of the plurality of rectangular handrails is a fixed length handrail.

3. The temporary safety guardrail for construction sites of claim 2, wherein the fixed length handrail is approximately 84 inches in length.

4. The temporary safety guardrail for construction sites of claim 1, wherein each of the plurality of rectangular handrails is a telescoping handrail.

5. The temporary safety guardrail for construction sites of claim 4, wherein the telescoping handrail extends up to 68 inches in length.

6. The temporary safety guardrail for construction sites of claim 1, further comprising at least one orientable bracket configured to attach to the rectangular fixed bracket, wherein each of the plurality of rectangular handrails is configured to attach to the orientable bracket, the orientable bracket is configured to pivot.

7. The temporary safety guardrail for construction sites of claim 6, wherein when the at least one orientable bracket is pair of brackets connected in series, in which a first of the two of the at least one of the orientable bracket pivots in one plane and a second of the at least one orientable bracket pivots in a plane perpendicular to the plane of the first of the at least one orientable bracket such that orientation occurs in two perpendicular axes.

8. The temporary safety guardrail for construction sites of claim 6, wherein the orientable bracket comprises a body section and a pair of fins, wherein the body section is rectangular and having four sides, and at least one hole provided on each of the four sides and each of the pair of fins, the holes located on the body section and the fins are configured for attachment to the rectangular fixed bracket and each of the plurality of rectangular handrails via a second pin.

9. The temporary safety guardrail for construction sites of claim 1, further comprising a marker stub positioned on a lower portion of the removable post.

10. The temporary safety guardrail for construction sites of claim 9, wherein a kickplate bracket is configured to attach to the marker stub and receive a kickplate.

11. The temporary safety guardrail for construction sites of claim 1, further comprising at least one alignment hook having a plurality of notches, wherein the at least one alignment hook is configured to secure the threads of the net in the notches.

12. The temporary safety guardrail for construction sites of claim 1, wherein each of the rectangular handrails include hooks configured to attach to the upper band of the net, the hooks configured to create tension in the net.

13. The temporary safety guardrail for construction sites of claim 12, wherein the hooks are positioned on alternating sides of the handrails.

14. The temporary safety guardrail for construction sites of claim 1, further comprising at least one band clamp positioned on the removable post, the at least one band clamp configured to secure the lower band of the net and to adjust tension in the net by selective positioning into a plurality of adjustment holes.

* * * * *